United States Patent [19]

Sorin

[11] 4,403,883

[45] Sep. 13, 1983

[54] PAPER FASTENER DEVICE SYSTEM

[76] Inventor: Georgia L. Sorin, 2009 N. Park Rd., Hollywood, Fla. 33021

[21] Appl. No.: 301,182

[22] Filed: Sep. 11, 1981

Related U.S. Application Data

[63] Continuation of Ser. No. 98,833, Nov. 30, 1979, abandoned.

[51] Int. Cl.[3] ..... B42F 13/00

[52] U.S. Cl. ..... 402/79; 281/25 R; 402/80 R

[58] Field of Search ..... 402/8, 21, 68, 70, 73, 402/75, 79, 63, 77, 80 R; 281/25 R

[56] References Cited

U.S. PATENT DOCUMENTS

| | | | |
|---|---|---|---|
| 1,172,010 | 2/1916 | Cooke, Jr. | 402/79 |
| 1,354,894 | 10/1920 | Delkin | 402/79 |
| 2,169,953 | 8/1939 | Jeffers | 402/75 X |
| 2,324,259 | 7/1943 | Havel | 402/8 |
| 3,221,751 | 12/1965 | Brandon | 402/75 X |
| 3,301,264 | 1/1967 | Usoskin | 281/25 R X |
| 3,307,858 | 3/1967 | Sanden | 402/79 |
| 3,503,695 | 3/1970 | Giampa | 402/68 X |

FOREIGN PATENT DOCUMENTS

| | | | |
|---|---|---|---|
| 1531482 | 11/1978 | United Kingdom | 402/73 |

*Primary Examiner*—Paul A. Bell
*Assistant Examiner*—John S. Brown
*Attorney, Agent, or Firm*—Eugene F. Malin

[57] ABSTRACT

An office file paper fastener device system for indexing papers, each of which includes a card that is attachable by a first set of holes to a file folder and having a separate set of holes for attaching a connector upon which a bundle of file papers may be connected. Each bundle of the file papers are attached to its respective fastener device and card independently of the first set of holes by which the card is attached to the file folder, a hole-making fastener device. Several cards may be attached to a single file folder connector. The paper fastener device system provides an indexing system that allows removal of the cards without removing each bundle of file papers from the connector on the respective card. The system thereby eliminates removal of all the contents filed in superposition to the file folder to remove a particular piece of paper.

1 Claim, 5 Drawing Figures

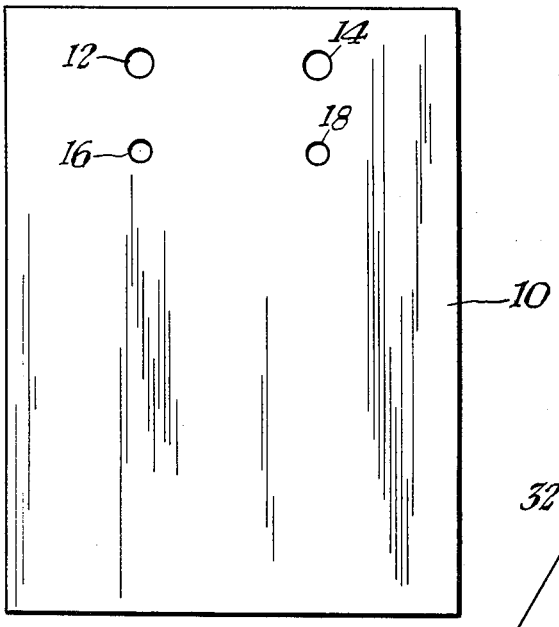
Fig. 1.
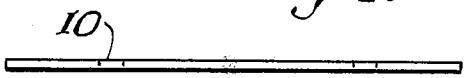
Fig. 2.
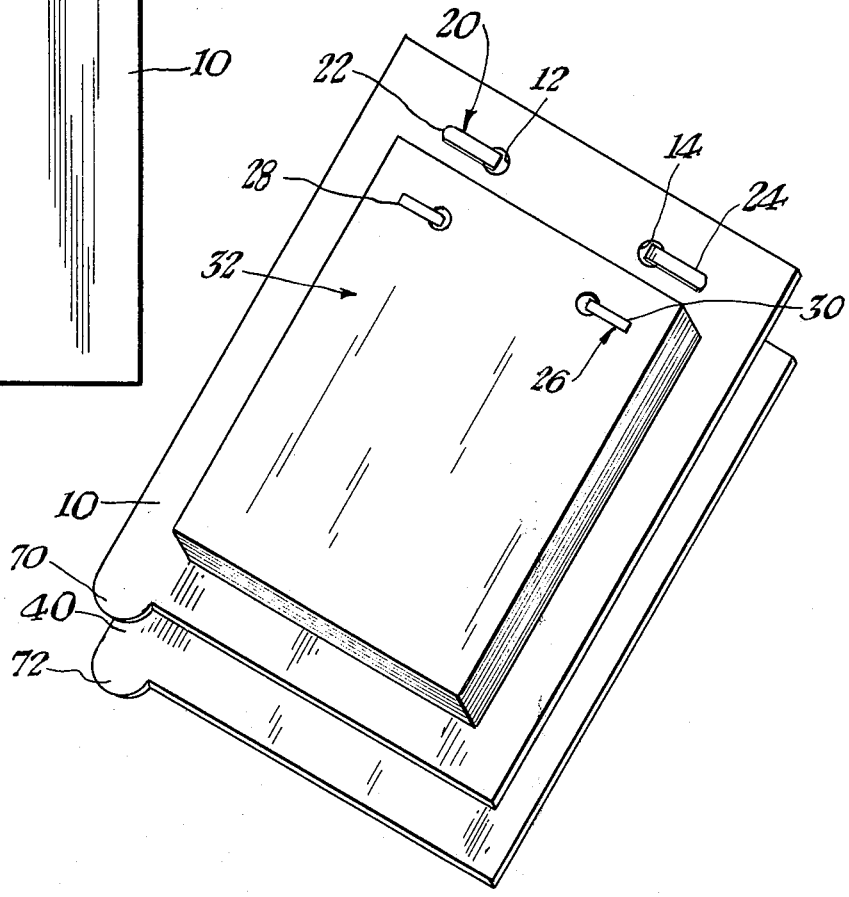
Fig. 3.
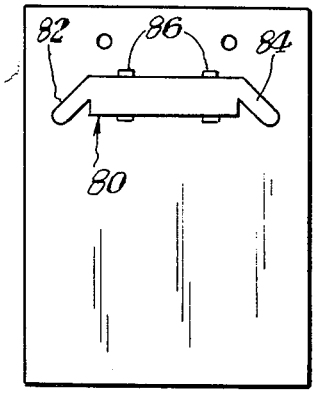
Fig. 5.
Fig. 4.
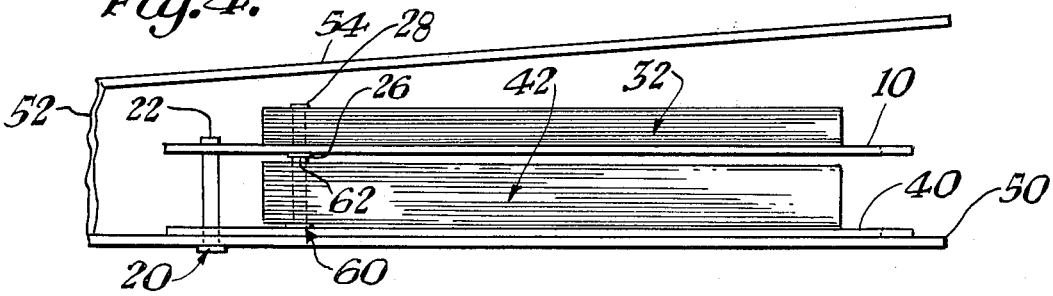

PAPER FASTENER DEVICE SYSTEM

This is a continuation of application Ser. No. 98,833, filed Nov. 30, 1979, now abandoned.

BACKGROUND OF THE INVENTION

This invention is a paper fastener device system having one card with two spaced fastening means, a first means for connection to a file folder connector and a second means for holding a bundle of file papers.

Prior art devices such as binder described in U.S. Pat. No. 1,792,740 and fastener described in U.S. Pat. No. 2,595,108 are bulky complex high-cost fastener devices.

SUMMARY OF THE INVENTION

This invention relates to a non-complex index means for office file folders. The cards or index leaves are constructed from a single sheet of file folder material with a first pair of holes near the top and a second pair of holes positioned a small distance below the first pair. The top pair of holes is for receiving a first bendable metal connector or tabs inserted from a file folder. The file folder connector may hold a plurality of cards. The lower pair of holes is for attaching a bundle of file papers for indexing by a connector or a second metal tab inserted only through the card or index leaf. Several cards or index leaves may be attached in a single file folder, each card or leaf with its respective contents of file papers. The index leaves may also be provided with a labeling tab.

This invention is useful, especially in active files of large content which require frequent removal and replacement of contents throughout the file.

It is an object of this invention to provide a means for indexing separately-bundled file papers in a single office file folder.

It is another object of this invention to provide a means for attaching a bundle of file papers to an index card.

It is yet another object of this invention to provide a non-complex, low-cost means for inserting and removing specific indexed portions of a file without having to remove all contents superpositioned to the desired contents.

In accordance with these and other objects which will be apparent hereinafter, the instant invention will now be described with particular reference to the accompanying drawings.

BRIEF DESCRIPTION OF THE DRAWINGS

FIG. 1 is a front view of the card or index leaf.

FIG. 2 is a side view of the card shown in FIG. 1.

FIG. 3 is an isometric view of a plurality of fastener devices attached in a conventional office file folder connector with each tabbed card having a connector holding a bundle of file papers.

FIG. 4 is a side view of that shown in FIG. 3 with the file folder connector attached to a file folder with the top leaf raised.

FIG. 5 is a top view of a card with a first connecting hole means and a second connecting means that is a permanently attached tab.

PREFERRED EMBODIMENT OF THE INVENTION

Referring to the drawings, all elements bear the same number throughout the figures. Referring now to FIGS. 1, 3, and 4 showing a paper fastener system made up of a removable card or index leaf 10 or item carrier means having a portion of a first connecting means 12 and 14 or a mating first connecting means for attachment of the card to a file connector in a file folder. The mating first connecting means is attachable or connectable to the other mating first connecting means or file member mating first connecting means 20 that is itself connected to the file folder member 50. Therefore, the first connecting means includes a first pair of holes 12 and 14 and the file folder connector 20 also referred to in broader terms as the other mating first connecting means.

The second connecting means or item contents connecting means includes a mating second connecting means or a second pair of holes 16 and 18 spaced between the first set of holes 12 and 14 and the lower end of the index leaf 10, and the other mating second connecting means 26. In FIG. 2, the card is shown to illustrate that all the holes pass through the card.

Referring to FIGS. 3 and 4, the cards of index leaves 10 and 40 are attached to an office file folder 50 by the other mating first connector means 20 via a first bendable metal tab retainer portion 22 and a second bendable metal tab retainer portion 24. The other mating first connector means 20 mates with the mating first connecting means or holes 12 and 14. File contents 32 are retained on the card or index leaf 10 or item carrier means by the other mating second connector means 26 by a first bendable metal tab retainer portion 28 and a second bendable metal tab retainer portion 30 which is the second pair of holes 16 and 18. The second card 40 is attached to connector 20 in a similar manner as shown in FIG. 4. The cards or leaves 10 and 40 or paper carrier means each of which may include a body portion and tabs 70 and 72. The connector 20 has a back and two tab retainer portions. The connector 20 is inserted in the back of one file folder member 50 with the cards of index leaves 10 and 40 being retained in the folder by metal tab connector 20 with arms 22 and 24. The file contents 32 and 42 or item are being retained on their respective cards of index leaves by metal tabs 26 and 60 respectively. Tabs 26 and 60 have back members and two tab retainer portions.

As shown in FIG. 4, the file folder includes a top cover 54 and a connecting portion 52.

The file folder may have a base member and an unconnected top member. The top member can be connected to the base member and the cards by the connector 20.

FIG. 5 shows another embodiment with a connector 80 having two tabs such as two flexible members 82 and 84 and body 86 and connecting flanges 88 that pass through the card. Such a fastening may be connected by glue or other adhesive means.

The connecting means and holes may be positioned on the side of each card as well as at the top.

Various file folders may be used with holes, connectors, or a connector such as 80.

The instant invention has been shown and described herein in what is considered to be the most practical and preferred embodiment. It is recognized, however, that departures may be made therefrom within the scope of the invention and that obvious modifications may occur to a person skilled in the art.

What I claim is:

1. A paper fastener system for supporting filed items comprising:

file member for storing the filed items, a plurality of carrier means each including a body portion, a first connecting means connected to and between said file member and each said paper carrier means, and a second connecting means connected to each said body portion and spaced apart from said first connecting means, said first connecting means including a foldable metal fastener and holes in each body portion for removably connecting said paper carrier means to said file member, whereby the filed items removably connected on one said body portion may be removed separately without removal of other filed items on another paper carrier means, at least two holes in each said body portion for removably connecting each said paper carrier means from said file member, each said second connecting means includes at least two connecting openings spaced apart from said first connecting means, and a mating item fastener means for connecting each said body portion to said filed items on each said paper carrier means, said mating item fastener means is a foldable flat metal paper fastener, said body portion is a card, and said card includes an index tab.

* * * * *